US006336411B1

(12) United States Patent
Bell

(10) Patent No.: US 6,336,411 B1
(45) Date of Patent: Jan. 8, 2002

(54) LIGHTWEIGHT BOXCAR ROOF

(75) Inventor: Edward A. Bell, Munster, IN (US)

(73) Assignee: Stanrail Corporation, Gary, IN (US)

( * ) Notice: Subject to any disclaimer, the term of this patent is extended or adjusted under 35 U.S.C. 154(b) by 0 days.

(21) Appl. No.: 09/552,051

(22) Filed: Apr. 19, 2000

(51) Int. Cl.[7] ..... B61D 17/00

(52) U.S. Cl. ..... 105/404; 105/396; 52/45; 52/51; 52/52; 52/53

(58) Field of Search ..... 105/396, 404, 105/409; 52/17, 22, 45, 46, 51, 52, 53

(56) References Cited

U.S. PATENT DOCUMENTS 1,681,819 A * 8/1928 Small ..... 52/52
1,810,446 A * 6/1931 Swason ..... 52/52
1,870,398 A * 8/1932 Bonsall ..... 52/52
1,878,430 A * 9/1932 Swanson ..... 52/52
1,880,085 A * 9/1932 Gilpin ..... 52/52
2,034,377 A * 3/1936 Bonsall ..... 52/52
2,034,379 A * 3/1936 Bonsall ..... 52/52
2,034,382 A * 3/1936 Bonsall ..... 52/52
2,085,338 A * 6/1937 Schlesinger ..... 52/52
2,085,540 A * 6/1937 Murphy ..... 52/52
2,106,988 A * 2/1938 Tatum ..... 52/52
2,204,348 A * 6/1940 Finger ..... 105/404
2,242,766 A * 5/1941 Torburn ..... 105/404
2,243,113 A * 5/1941 Mussey et al. ..... 105/404
2,350,213 A * 5/1944 Bonsall ..... 52/52
5,988,074 A * 11/1999 Thoman ..... 105/404

* cited by examiner

*Primary Examiner*—S. Joseph Morano
*Assistant Examiner*—Lars A. Olson
(74) *Attorney, Agent, or Firm*—Cook, Alex, McFarron, Manzo, Cummings & Mehler, Ltd.

(57) ABSTRACT

A roof assembly for a railroad boxcar having centrally located side door openings. The roof assembly is formed of a number of roof panels each of generally rectangular shape and having longitudinally and laterally located edges. The roof panels are positioned on the boxcar with the longitudinal edges of the panels supported on top side plates of the boxcar. The roof panels include end panels, intermediate panels and door overlying panels. Each of the end panels is located at one of the longitudinal ends of the boxcar and has a laterally located edge. The door overlying panels are positioned over the centrally located side doors of the boxcar. The intermediate panels are positioned between the end panels and the door overlying panels. Each of the intermediate panels is wider than each of the door overlying panels and wider than the end panels. Each intermediate panel is formed with four corrugations while each end panel and door overlying panel is formed with two corrugations. The intermediate panels and the door overlying panels are each formed of 14 gauge galvanized iron while the end panels are formed of 12 gauge galvanized iron.

10 Claims, 3 Drawing Sheets

*Fig. 7*

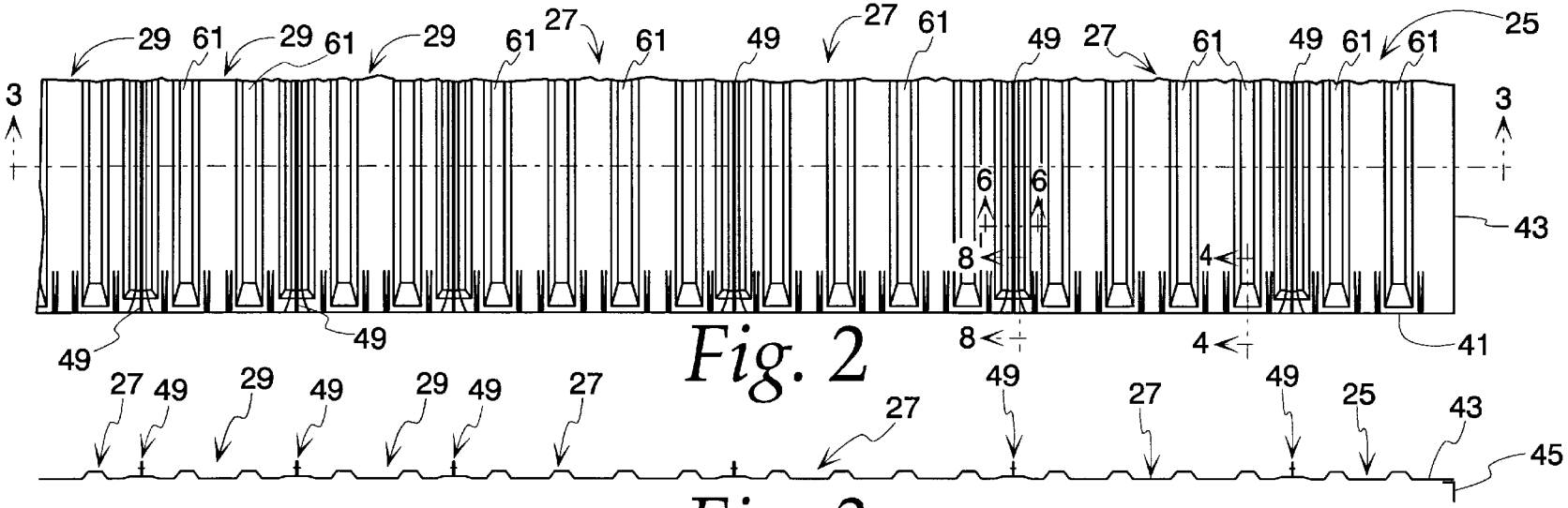
Fig. 2
Fig. 3
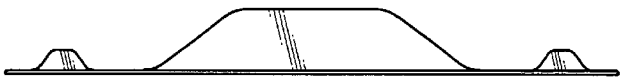
Fig. 5
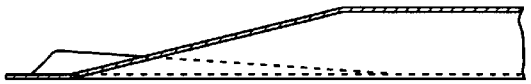
Fig. 4
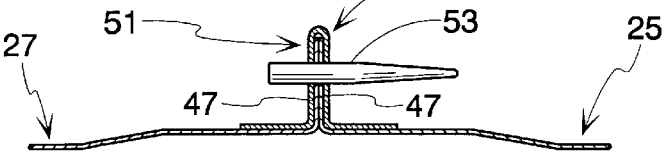
Fig. 6

LIGHTWEIGHT BOXCAR ROOF

BACKGROUND AND SUMMARY OF THE INVENTION

This invention is directed to a lightweight roof for a railroad boxcar which is formed of larger sheets of galvanized steel than have been conventionally used in the industry for boxcar roofs.

An object of this invention is a boxcar roof having fewer but larger roof sheets than prior boxcars to reduce the cost of installation of the roof.

Another object of this invention is a boxcar roof that is more resistant to leakage because fewer seam caps and thus fewer seam cap rivet passages are provided.

Yet another object of this invention is a lightweight roof assembly in which stronger roof panels are provided over the side door openings of the boxcar.

Still another object of this invention is a lightweight roof for a boxcar that is considerably lighter than conventional boxcar roofs.

BRIEF DESCRIPTION OF THE DRAWINGS

FIG. 2 is a top plan view of the roof assembly portion shown in FIG. 1;

FIG. 3 is a cross sectional view taken along line 3—3 of FIG. 2 and exaggerated in a vertical direction;

FIG. 4 is an enlarged, cross sectional view taken along line 4—4 of FIG. 2;

FIG. 5 is an enlarged, end elevational view of a corrugation and pleats of a typical roof panel;

FIG. 6 is an enlarged, cross sectional view taken along line 6—6 of FIG. 2;

DESCRIPTION OF THE PREFERRED EMBODIMENT

Figure 1:
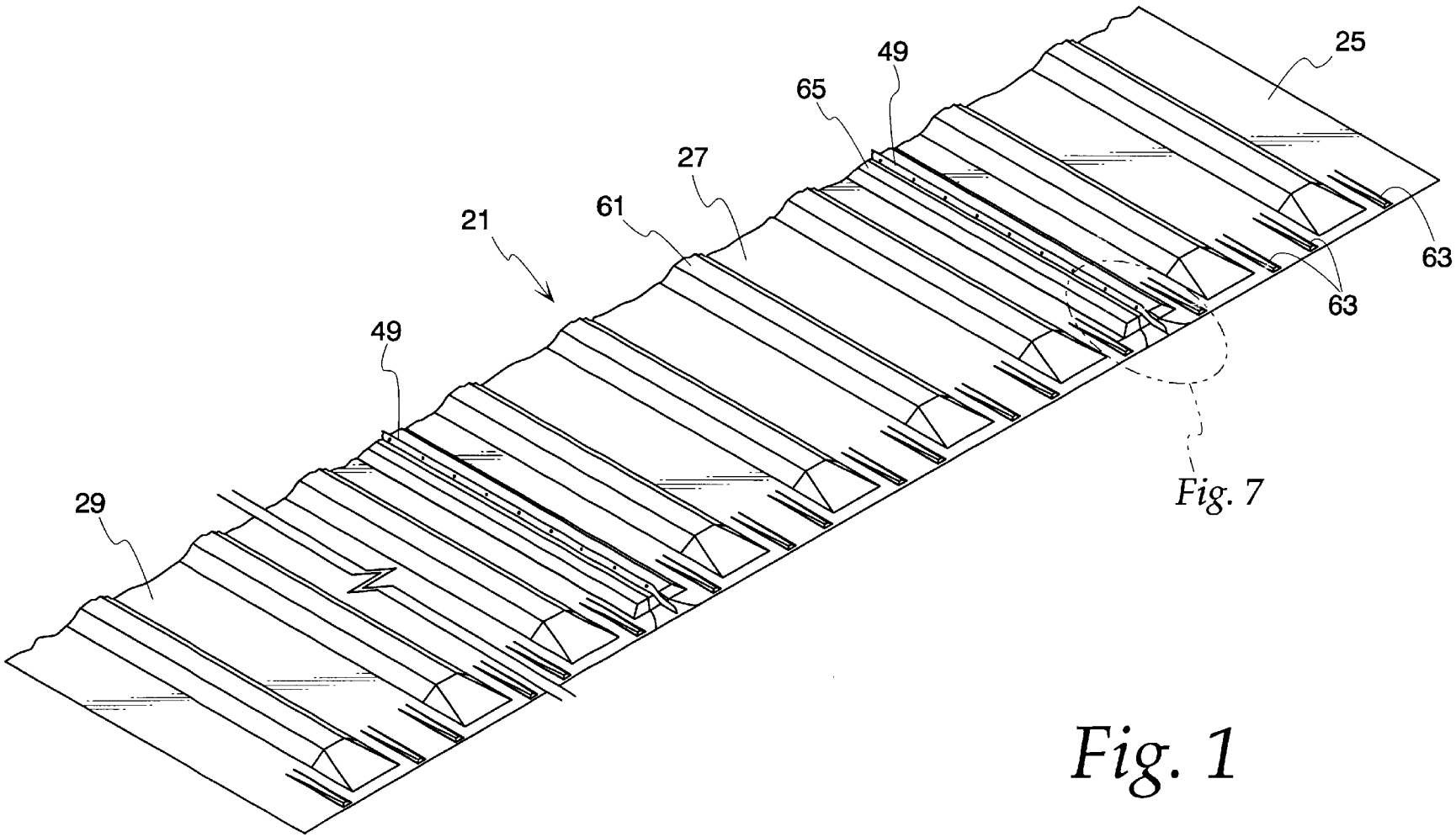
FIG. 1 an orthographic view of a portion of the roof assembly of this invention with portions broken away.

FIG. 1 of the drawings shows a portion of one longitudinally extending side of a boxcar roof 21 embodying the novel aspects of this invention. Such a roof 21 may be installed on boxcars of standard lengths, which in North America range from 40 to 86 feet. For clarity and conciseness of explanation, the novel aspects of the invention will be illustrated and described as they are embodied in a railroad boxcar 23 which is 60' in length. With suitable modifications, a roof incorporating the novel aspects of this invention may also be installed on boxcars which are longer or shorter than 60' in length.

The lightweight roof 21 of this invention consists of thirteen rectangular panels of galvanized steel. These panels include two rectangular end panels 25 each approximately 42⅝" wide and formed of 12 gauge steel. The roof also includes six rectangular intermediate panels 27 each approximately 72¾" wide and formed of 14 gauge steel. Additionally, the roof includes five rectangular door overlying panels 29 each approximately 41" wide and formed of 14 gauge steel. The dimension of each panel, which is described as its width, extends longitudinally of the railroad car when a panel is installed as part of the roof on the boxcar. All of the panels have the same length, approximately 110 inches before forming and shearing, for a boxcar of nine feet, six inches inside width.

The panels 25, 27 and 29 are arranged starting from one end of the boxcar to the opposite end (from the right hand side to the left hand side as viewed in FIGS. 1 and 2) in the following order: an end panel 25, three intermediate panels 27, five door overlying panels 29, three intermediate panels 27 and one end panel 25.

Figure 8:
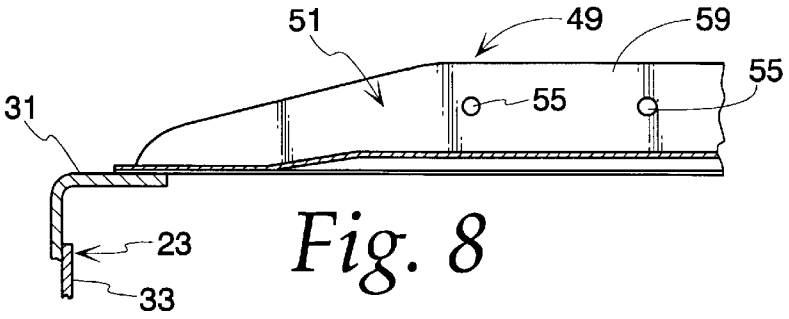
FIG. 8 is an enlarged view taken along line 8—8 of FIG. 2 showing an end of a seam cap supported top side plate of a boxcar.

Each of the panels 25, 27 and 29 is formed with oppositely spaced longitudinally and laterally located edges with the longitudinal edges of the panels supported on top side plates 31 (FIG. 8) which in turn are fastened to side walls 33 of the boxcar 23. Because the longitudinally and laterally located edges of each of the three sizes of panels 25, 27 and 29 are similar in shape to permit the connection of contiguous panels and the support of one edge of each end panel 25 on the end walls of a boxcar, only the seam connection between an end panel 25 and an intermediate panel 27 will be shown and described in detail but it should be understood and appreciated that identical seam connections are made between contiguous panels 25, 27 and 29 making up the lightweight roof 21 of this invention.

The end panels 25 have longitudinally located edges 41 and laterally located edges, one of which 43 is flat and is supported on a top end plate 45 of the boxcar as shown in FIG. 3 and the other edge 47 is upturned as shown in FIG. 6 to form part of a roof seam 49. Each of the intermediate and door overlying panels have a pair of upturned laterally located edges 47 which become parts of roof seams 49.

Figure 9:
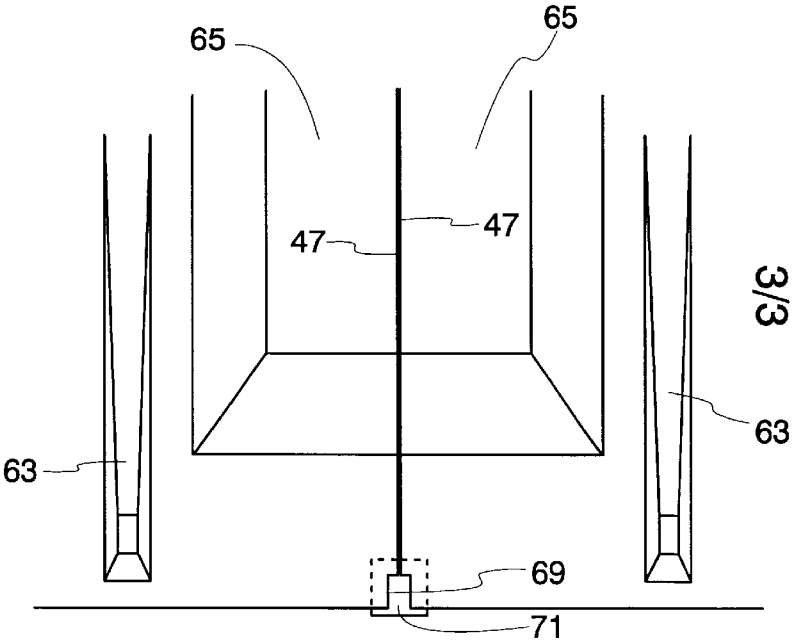
FIG. 9 is an enlarged, partial, top plan view of a seam between adjacent roof panels prior to the installation of a seam cap.
Figure 7:
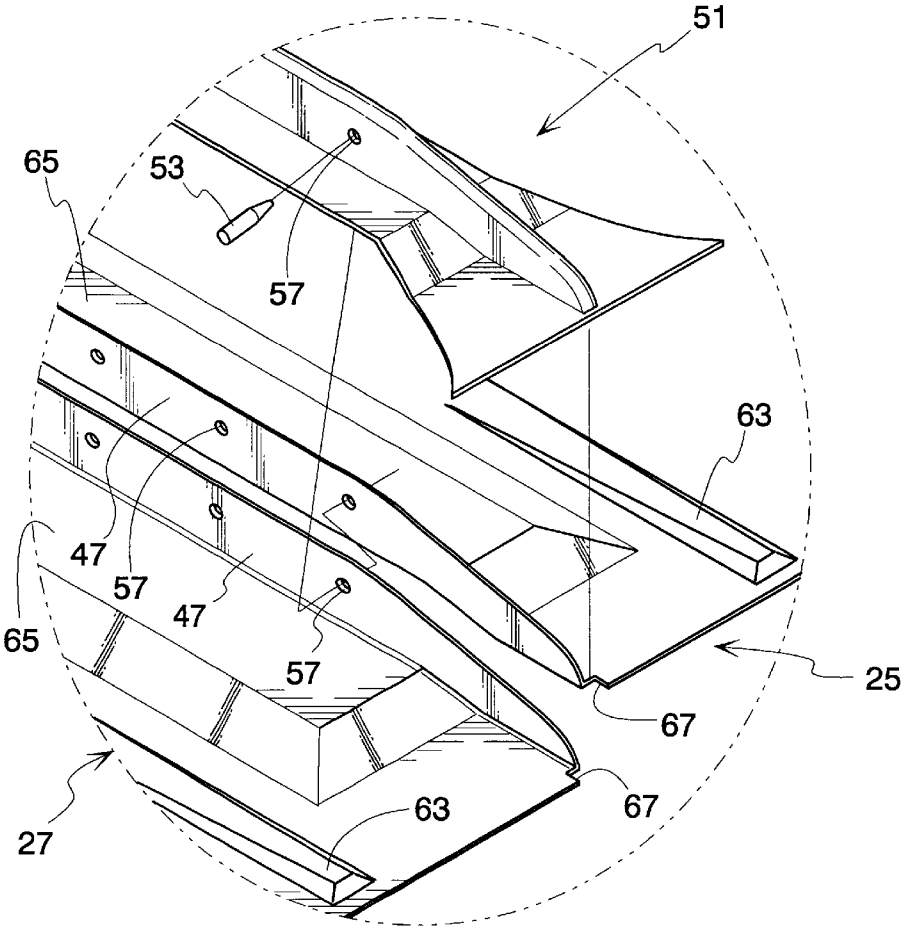
FIG. 7 is an exploded view of a portion of the roof panel of FIG. 1.

Each roof seam 49 includes a seam cap 51, shown in the exploded view of FIG. 7 of the drawings, which view depicts an upturned edge 47 of an end panel 25 prior to attachment to an upturned edge 47 of an intermediate panel 27. The attachment between panels is made by lowering the seam cap 51 over the abutting upturned edges 47 of the panels 25 and 27 as shown in FIG. 9 to the assembly stage shown in FIG. 6 where barrel shaped roof pins 53 hold the seam cap 51 in position for the installation of cold squeeze rivets 55. These rivets are inserted into aligned passages 57 formed in the blade portion 59 of the seam cap and the upturned edges 47 of the end panel 25 and intermediate panel 27 as shown in FIG. 7 of the drawings. Similar roof seam assemblies 49 are made between contiguous panels of the roof 21 whether the panels are of the same width or of different widths and weights exhibited by the three types of panels 25, 27 and 29.

Novel aspects of this invention also reside in the selection of material for and the formation of the roof panels in order to obtain maximum strength and durability with minimum weight, low cost of assembly and resistance to leakage. The end panels 25 and the seam caps 51 are formed of 12 gauge galvanized steel while the panels 27 and 29 are formed of 14 gauge galvanized steel. The end panels 25 and door overlying panels 29 are each formed with two pyramidal type corrugations 61 while the intermediate panels 27 are formed with four corrugations 61. The corrugations are of the type conventionally used for reinforcing roof panels in the railroad car building industry. Located between each pair of corrugations 61 and positioned near the longitudinally located edges of the panels are pleats 63 which take up excess metal at the edges of the panel occasioned by the forming of the corrugations 61.

Formed adjacent each upturned edge 47 of a panel is a formed portion called a marginal panel 65 which blends into the upturned edge 47 of the panel as is shown most clearly in FIGS. 7 and 9. An additional pleat 63 is formed adjacent each marginal panel to absorb the excess metal.

As can be best seen in FIGS. 7 and 9, the longitudinally located edges of the panels are sheared at 67 to form a rectangular cutout or cope 69 between the panels. The provision a cope 69 permits the edges 47 to be bent upwardly without distorting the metal at the outer edge of each adjacent panel. A rectangular filler of 14 gauge metal 71 is welded to the undersurface of the panels and fills the rectangular cope 69 before the seam cap 51 is secured in position. The filler extends approximately ¼" outwardly of the longitudinally located edges of the panels. The provision of a filler 71 at the outer edges of each roof seam 49 prevents the seepage of water beneath the seam cap and through the roof seam.

To complete the assembly, the seam caps 51 are placed over the upstanding edges 47 of the contiguous roof panels and the barrel pins 53 are inserted through the passages 57 to force the seam cap against the roof panels. The rivets 55 are then installed first in the passages 57 without roof pins. After the initial rivets are installed, the barrel pins 53 are removed and rivets are installed in the remaining passages 57. Because of the use of intermediate panels 27 which are wider than roof panels previously used for the roofs of railroad boxcars, fewer roof seams 49 are required in the roof 21 of this invention. The use of fewer roof seams and fewer seam caps 51 results in fewer passages 57 through which water may seep.

What is claimed is:

1. A roof assembly for a railroad boxcar having top side plates and generally centrally located side door openings on opposite sides of said boxcar, said roof assembly including:

a plurality of roof panels each of generally rectangular shape having longitudinally located edges and laterally located edges, said roof panels positioned on said boxcar with said longitudinally located edges of said panels supported on said top side plates, said plurality of roof panels including a plurality of end panels, a plurality of intermediate panels and a plurality of door overlying panels, each of said end panels located at a longitudinal end of said boxcar and having a laterally located edge, said plurality of door overlying panels positioned over said centrally located said side doors of said boxcar, said intermediate panels positioned between said end panels and said door overlying panels, each of said intermediate panels is wider than each of said door overlying panels.

2. The roof assembly of claim 1 in which each of said intermediate panels is wider than each of said end panels.

3. The roof assembly of claim 1 in which each of said intermediate panels is formed of metal which is of a lighter gauge than the metal of each of said end panels.

4. The roof assembly of claim 1 in which each of said intermediate panels is formed with four corrugations.

5. The roof assembly of claim 1 in which each of said door overlaying panels is formed with two corrugations.

6. The roof assembly of claim 1 in which each of said end panels is formed with two corrugations.

7. The roof assembly of claim 1 in which each of said door overlying panels is formed of metal which is of lighter gauge than the metal of each of said end panels.

8. A roof assembly a railroad boxcar having top side plates and generally centrally located side door openings on opposite sides of said boxcar, said roof assembly including:

a plurality of roof panels each of generally rectangular shape having longitudinally located edges and laterally located edges, said roof panels positioned on said boxcar with said longitudinally located edges of said panels supported on said top side plates, said plurality of roof panels including a plurality of end panels, a plurality of intermediate panels and a plurality of door overlying panels, each of said end panels located at a longitudinal end of said boxcar and having a laterally located edge, said plurality of door overlying panels positioned over said centrally located said side doors of said boxcar, said intermediate panels positioned between said end panels and said door overlying panels, each of said intermediate panels is wider than each of said door overlying panels, each of said intermediate panels is wider than each of said end panels, each of said intermediate panels is formed of metal which is of a lighter gauge than the metal of each of said end panels, and each of said door overlying panels is formed of metal which is of lighter gauge than the metal of each of said end panels.

9. The roof assembly of claim 8 in which each said intermediate panels is formed of 12 gauge galvanized steel and each of said end panels is formed of 12 gauge galvanized steel.

10. The roof assembly of claim 8 in which each of said door overlying panels is formed of 14 gauge galvanized steel and each of said end panels is formed of 12 gauge galvanized steel.

* * * * *